US011135731B2

(12) United States Patent
Scimone et al.

(10) Patent No.: US 11,135,731 B2
(45) Date of Patent: Oct. 5, 2021

(54) CUTTING DEVICE HAVING A LOCKING MEMBER

(71) Applicant: Slice, Inc., San Jose, CA (US)

(72) Inventors: Thomas Scimone, Campbell, CA (US); Scot Herbst, Santa Cruz, CA (US); Fu Keung Ng, Kowloon (HK)

(73) Assignee: Slice, Inc., Sunny Isles, FL (US)

( * ) Notice: Subject to any disclaimer, the term of this patent is extended or adjusted under 35 U.S.C. 154(b) by 125 days.

(21) Appl. No.: 15/853,734

(22) Filed: Dec. 23, 2017

(65) Prior Publication Data

US 2019/0193289 A1 Jun. 27, 2019

(51) Int. Cl.
*B26B 5/00* (2006.01)
*B26B 29/02* (2006.01)
*B26B 1/08* (2006.01)

(52) U.S. Cl.
CPC ..... *B26B 5/003* (2013.01); *B26B 5/001* (2013.01); *B26B 29/025* (2013.01); *B26B 1/08* (2013.01)

(58) Field of Classification Search
CPC ..... B26B 5/001; B26B 5/003
See application file for complete search history.

(56) References Cited

U.S. PATENT DOCUMENTS 2,391,574 A * 12/1945 Housinger ..... B26B 29/025 30/151
3,262,205 A * 7/1966 Arden ..... A61B 17/3213 30/338
3,657,812 A * 4/1972 Lee ..... B26B 1/08 30/162
4,277,888 A * 7/1981 Szabo ..... B26B 5/002 30/162
4,663,846 A * 5/1987 Takayama ..... B26B 5/001 30/162
4,744,146 A * 5/1988 Schmidt ..... B26B 5/001 30/125
4,895,147 A * 1/1990 Bodicky ..... A61B 5/150022 600/583
5,123,067 A * 6/1992 Avelange ..... G02B 6/4246 385/14
5,477,615 A * 12/1995 Wakao ..... B26B 5/00 30/162
5,507,076 A * 4/1996 Anscher ..... A44B 11/266 24/616
5,569,282 A * 10/1996 Werner ..... A61B 17/3211 30/162

(Continued)

*Primary Examiner* — Ghassem Alie
*Assistant Examiner* — Fernando A Ayala
(74) *Attorney, Agent, or Firm* — Ellenoff Grossman & Schole LLP; James M. Smedley; Alex Korona

(57) ABSTRACT

A cutting device is disclosed. The cutting device has a housing and a carriage that is movably disposed in the housing, the carriage being movable between a retracted position and an extended position. The cutting device also has a cutting member that is removably disposable in the carriage and a cover member that is removably attachable to the housing. The housing has a locking member. When the carriage is in the extended position and the cover member is attached to the housing, the locking member locks the cover member to the housing. When the cutting member is disposed in the carriage in the extended position, the cutting member is retained in the housing by the locked cover member.

19 Claims, 5 Drawing Sheets

(56) References Cited

U.S. PATENT DOCUMENTS 5,571,128 A * 11/1996 Shapiro ..... A61B 17/3211 606/167
6,125,489 A * 10/2000 Zeller ..... B26B 11/00 30/125
6,151,786 A * 11/2000 Hellstern ..... B26B 9/00 30/346
6,192,589 B1 * 2/2001 Martone ..... B26B 5/001 30/125
6,484,537 B2 * 11/2002 Takessian ..... A44C 17/0208 63/26
6,503,262 B1 * 1/2003 Edens ..... A61F 9/0133 606/166
8,256,330 B2 * 9/2012 Auchter ..... A61B 17/3211 30/151
8,578,613 B2 * 11/2013 Nallakrishnan .... A61B 17/3213 30/151
8,943,700 B2 * 2/2015 Cetola ..... A61B 17/3213 30/162
10,207,414 B2 * 2/2019 Groeneweg ..... B26B 5/003
2004/0087989 A1 * 5/2004 Brenneman ..... A61B 17/3213 606/167
2010/0024221 A1 * 2/2010 Hernandez ..... B26B 5/001 30/296.1
2012/0245610 A1 * 9/2012 Hajgato ..... A61B 17/3213 606/167
2012/0311869 A1 * 12/2012 Ichiyanagi ..... A61B 17/3213 30/151
2013/0255002 A1 * 10/2013 Keers ..... B25F 1/04 7/118
2014/0165409 A1 * 6/2014 Scimone ..... B26B 5/003 30/162
2014/0167409 A1 * 6/2014 Artsiely ..... F16L 21/06 285/337
2015/0182247 A1 * 7/2015 Shi ..... A61B 17/3217 606/167

* cited by examiner

CUTTING DEVICE HAVING A LOCKING MEMBER

TECHNICAL FIELD

The present disclosure generally relates to a cutting device, and more particularly to a cutting device having a replaceable blade.

BACKGROUND

Blade replacement typically occurs after tools such as seam rippers, box cutters, utility knives, and precision knives are used for a period of time. For example, seam rippers are tools used for removing attachments such as stitches and seams used in sewn articles. Over time, blades become dull with repeated use and are typically replaced. Replacing blades on conventional cutting tools such as, for example, steel blades, can often be difficult and unsafe. For example, a user may struggle with safely removing an old blade and replacing that old blade with a new, sharp blade. Users who are unfamiliar with a given tool using a steel or metallic blade may cut themselves as they try to detach an old blade and/or reattach a new blade such as a sharpened steel or metallic blade. Accordingly, a way for avoiding difficult replacement of sharp metallic blades and for safely using cutting devices exists.

The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a housing and a carriage that is movably disposed in the housing, the carriage being movable between a retracted position and an extended position. The cutting device also includes a cutting member that is removably disposable in the carriage and a cover member that is removably attachable to the housing. The housing includes a locking member. When the carriage is in the extended position and the cover member is attached to the housing, the locking member locks the cover member to the housing. When the cutting member is disposed in the carriage in the extended position, the cutting member is retained in the housing by the locked cover member.

In another aspect, the present disclosure is directed to a method. The method includes providing a housing that includes a locking member and providing a cutting assembly, the cutting assembly including a cutting member that is removably disposed in a carriage. The method also includes disposing the cutting assembly in the housing, the cutting assembly being movable between a retracted position and an extended position. The method further includes removably attaching a cover member to the housing and locking the locking member to the cover member by moving the cutting assembly to the extended position, the locked cover member retaining the cutting member. The method additionally includes unlocking the locking member from the cover member by moving the cutting assembly to the retracted position.

DETAILED DESCRIPTION AND INDUSTRIAL APPLICABILITY

Figure 1:
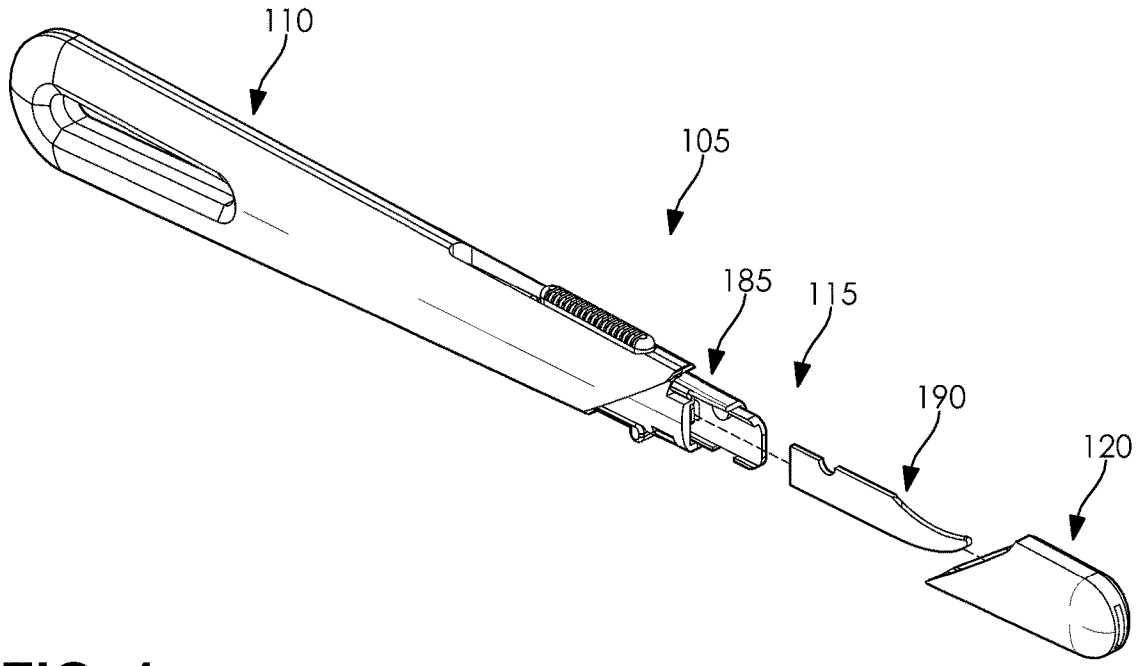
FIG. 1 is a perspective view of an exemplary cutting device in accordance with an embodiment of the present invention.
Figure 2:
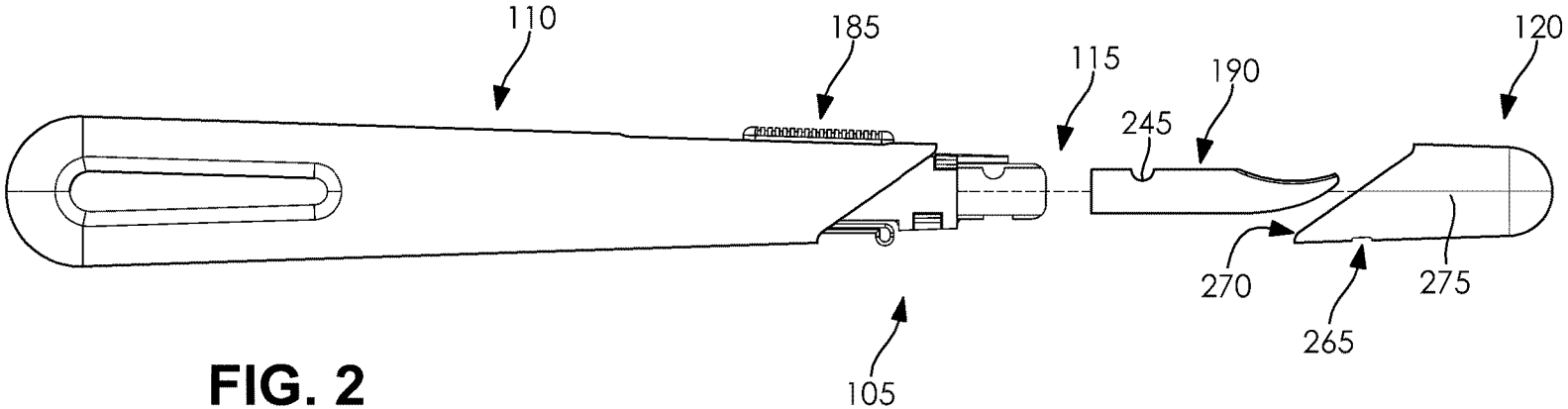
FIG. 2 is a side view of an exemplary cutting device in accordance with an embodiment of the present invention.

FIGS. 1 and 2 illustrate an exemplary cutting device 105. The exemplary cutting device disclosed herein may be any suitable device for cutting material such as, for example, a seam ripper, a box cutter, a utility knife, or a precision knife. For example, cutting device 105 may be a seam ripper or similar cutting device.

Cutting device 105 may include a housing 110, a cutting assembly 115, and a cover member 120. Cutting assembly 115 may be movably disposed in housing 110. Cover member 120 may be removably attachable to housing 110.

The exemplary cutting device may be constructed from any suitable variety of durable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, housing 110 and/or cover member 120 may be formed partially or substantially entirely from plastic, plastic composite, metal, and/or metal alloy materials. For example, housing 110 and/or cover member 120 may be plastic or metal structural members. Weights included in housing 110, described further below, may be formed for example from metal material. As described further below, cutting assembly 115 may include components formed from plastic, plastic composite, metal, and/or metal alloy materials and components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic. For example, cutting device 105 may include any suitable materials for use in a cutting device such as, e.g., a seam ripper, a box cutter, a utility knife, or a precision knife.

Housing 110 may provide, for example, a handle for cutting device 105 for use by a user. For example, housing 110 may be a seam ripper handle, or a handle of a box cutter, utility knife, or precision knife. For example, housing 110 may be a substantially hollow housing configured to receive and retain cutting assembly 115 as well as additional components such as the exemplary components described herein. For example, housing 110 may be a cylindrical housing. Also for example, housing 110 may be any other suitable shape such as, for example, a substantially regular tube shape, e.g., a square, triangular, hexagonal, and/or octagonal shape.

Figure 4:
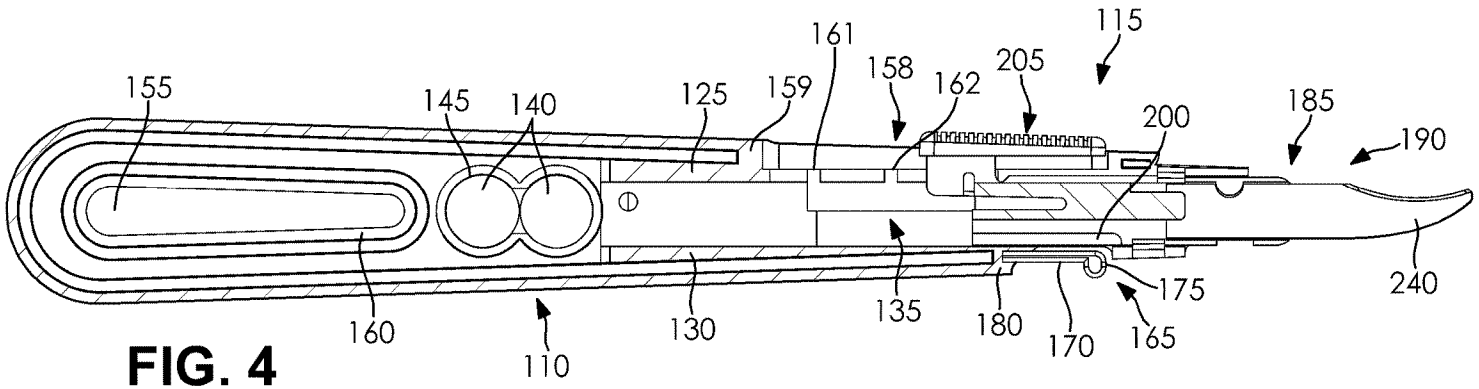
FIG. 4 is a sectional view of an exemplary cutting device in accordance with an embodiment of the present invention.

As illustrated in FIG. 4, housing 110 may include wall portions (e.g., portion 125 and portion 130). The plurality of wall portions may form a channel 135 within housing 110. Channel 135 may be configured to movably receive cutting assembly 115. For example, wall portions (e.g., portion 125 and portion 130) of housing 110 may act as ribs that fit into corresponding wall portions of cutting assembly 115. The interaction of corresponding wall portions (e.g., portions 125 and 130) of housing 110 and wall portions of cutting assembly 115 may prevent a rotation of cutting assembly 115 as it moves within housing 110.

Figure 5:
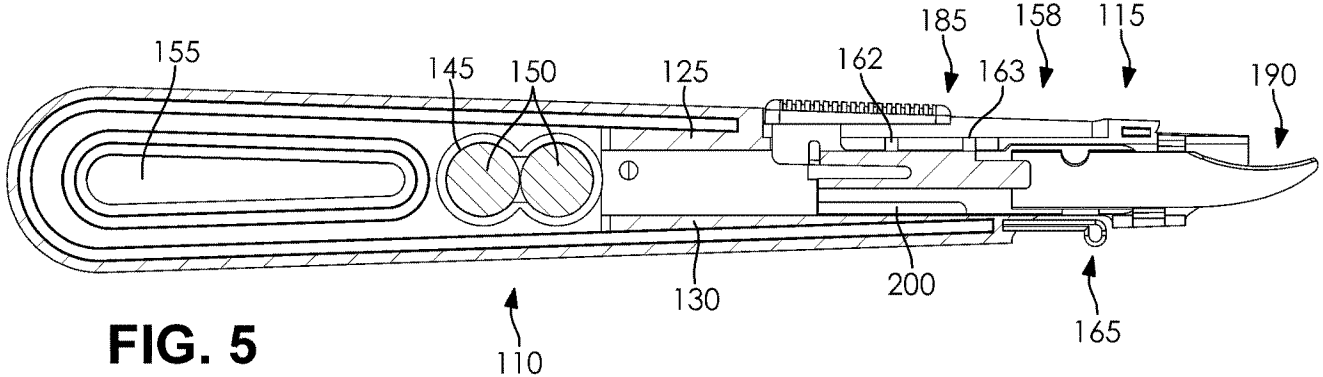
FIG. 5 is a sectional view of an exemplary cutting device in accordance with an embodiment of the present invention.

Housing 110 may include one or more cavities 140 that may be formed by a wall portion 145 of housing 110. As illustrated in FIG. 5, one or more cavities 140 may receive one or more weights 150. For example, weight 150 may be formed from relatively dense material such as metallic material. Because one or more weights 150 may be disposed away from (e.g., on another side of cutting device 105 away from) cutting assembly 115, weights 150 may add balance to cutting device 105 to help a user to better control a bladed end of cutting device 105. By providing a user with additional control, one or more weights 150 may help to provide for a suitable use of cutting device 105 by a user. Additionally for example, one or more weights 150 may provide additional balancing of cutting device 105 to provide suitable ergonomics to a user for the use of cutting device 105.

Housing 110 may include an aperture 155 formed by a wall portion 160. Aperture 155 may help facilitate a storage and/or carrying method for cutting device 105. For example, cutting device 105 may be placed on a hook or similar storage or carrying member via aperture 155. As illustrated in FIGS. 4 and 5, housing 110 may also include a plurality of recesses 161, 162, and 163. Recesses 161, 162, and 163 may receive a portion of carriage 185 as disclosed herein.

Housing 110 may include an aperture 158 formed by a portion 159 of housing 110. Portion 159 may be, for example, a wall portion of housing 110 such as an exterior wall portion. Aperture 158 may receive a portion of cutting assembly 115. For example, aperture 158 may be an elongated aperture that movably receives a portion of cutting assembly 115. For example, aperture 158 may be an elongated aperture (e.g., an elongated groove) along which a portion of cutting assembly 115 may be moved.

Housing 110 may also include a locking member 165. Locking member 165 may be formed from a similar material as other components of housing 110 as disclosed for example herein. Locking member 165 may include a first portion 170 and a second portion 175. First portion 170 may be an elongated member that extends from housing 110. Locking member 165 may be an integral part of housing 110 extending from a portion 180 of housing 110. Housing 110 may also be attached to housing 110, for example at a portion 180. For example, portion 170 of locking member 165 may be a substantially flexible member that is movable relative to portion 180 of housing 110. For example, locking member 165 may be an elongated member that cantilevers out from portion 180 of housing 110 or from any other suitable location of housing 110. For example, locking member 165 may be a plastic or plastic composite cantilevered member. It is also contemplated that locking member 165 may be attached or may be an integral part of another component of cutting device 105 such as, for example, cutting assembly 115 or cover member 120.

Figure 3:
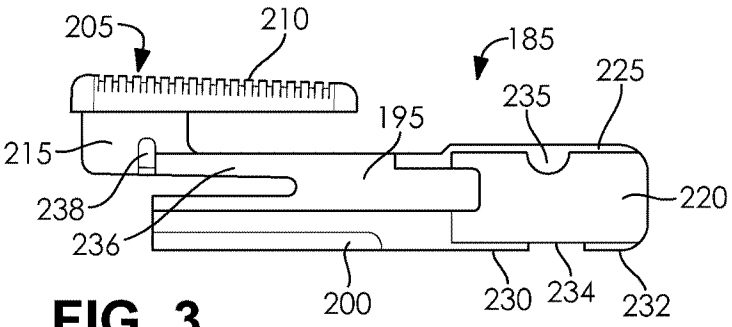
FIG. 3 is a perspective view of a component of an exemplary cutting device in accordance with an embodiment of the present invention.

Cutting assembly 115 may include a carriage 185 and a cutting member 190. Cutting member 190 may be removably disposable in carriage 185 (e.g., a blade carriage). Carriage 185 may be movably disposed within housing 110. For example, carriage 185 may be movably disposed within channel 135, which may be configured to receive carriage 185. As illustrated in FIG. 3, carriage 185 may include a plurality of wall portions (e.g., portion 195 and portion 200). Wall portions (e.g., portion 125 and portion 130) of housing 110 may act as ribs that fit into corresponding wall portions (e.g., portion 195 and portion 200) of carriage 185. The interaction of corresponding wall portions (e.g., portions 125 and 130) of housing 110 and wall portions (e.g., portions 195 and 200) of carriage 185 may allow carriage 185 to move (e.g., slide or translate in a forward or rearward direction along a length of cutting device 105) within housing 110 without rotation (e.g., the interaction of the wall portions of carriage 185 and housing 110 may substantially prevent a rotation of carriage 185 as it moves within housing 110). For example, carriage 185 may move within housing 110 between an extended position as illustrated in FIG. 4 and a retracted position as illustrated in FIG. 5. For example, carriage 185 may be moved to the retracted position, the extended position, or any position between the retracted position and the extended position.

Carriage 185 may include a member 205. Member 205 may be a member that extends or protrudes from carriage 185. Member 205 may include a plurality of protrusions 210 such as ridges disposed on a surface of member 205. Member 205 may be received in aperture 158 of housing 110. Member 205 may be moved along a length of aperture 158. For example, a length of aperture 158 of housing 110 may define a range of movement through which member 205 may be moved (e.g., may define the range of movement through which carriage 185 may be moved within housing 110). Member 205 may be an integral portion of carriage 185. Alternatively, member 205 may be a member that is attached to a portion 215 of carriage 185. A user of cutting device 105 may interact with member 205 to move carriage 185 within housing 110. Protrusions 210 may assist a user with maintaining positive contact (e.g., non-slipping contact) with member 205 as the user pushes or pulls at member 205.

Carriage 185 may include a cavity 220 that may be formed by a plurality of portions (e.g., wall portion 225 and wall portions 230 and 232) of carriage 185. An aperture 234 may be disposed between portions 230 and 232. Cavity 220 may be configured (e.g., shaped and/or sized) to receive a portion of cutting member 190. A portion (e.g., portion 225) of cavity 220 may include a protrusion 235. Protrusion 235 may be configured to be received by a portion of cutting member 190 when cutting member 190 is received in cavity 220. Cavity 220 may securely retain cutting member 190 in such a manner so as to substantially prevent cutting member 190 from becoming dislodged or otherwise falling out of carriage 185. The securing of cutting member 190 in cavity 220 of carriage 185 may be a friction-fit attachment between cutting member 190 and wall portion 225, wall portion 230, wall portion 232, and/or protrusion 235 of carriage 185. Carriage 185 may include a portion 236 disposed between portion 215 and portion 195. Portion 236 may be, for example, a lever or cantilever portion that may be flexible (e.g., portion 236 may be flexed when a user pushes on member 205). Carriage 185 may also include a protrusion 238 that may be received in recesses 161, 162, and/or 163 of housing 110 as disclosed for example herein.

Cutting member 190 may be any suitable blade or cutter for cutting of a material by cutting device 105. For example, cutting member 190 may be formed from a ceramic material that is capable of withstanding extended use before becoming dull or unusable. For example, cutting member 190 may be a ceramic blade. For example, cutting member 190 may include ceramic materials such as Zirconium Oxide or any other suitable ceramic materials for use in a blade. For example, cutting member 190 may be a ceramic blade that may be a hooked blade formed from Zirconium Oxide. Alternatively for example, cutting member 190 may be a metal blade or a blade formed from any suitable material than can be used for cutting materials. Cutting member 190 may include rounded tips to reduce the chance of a user being cut unintentionally by cutting member 190.

As illustrated in FIGS. 2 and 4, cutting member 190 may include a portion 240 that may be used for cutting material. Cutting member 190 may include a curved blade (e.g., portion 240). Portion 240 may be a relatively narrow portion (e.g., narrower relative the other portions of cutting member 190) of cutting member 190 that may serve to cut material. Cutting member 190 may also include an indentation or notch 245 that may receive protrusion 235 of carriage 185 to help retain cutting member 190 in carriage 185.

Figure 8:
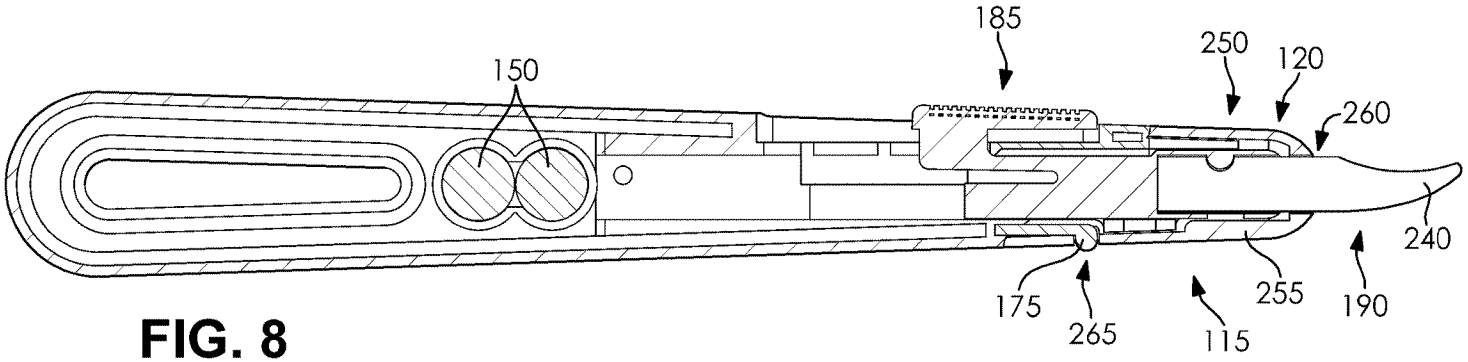
FIG. 8 is a sectional view of an exemplary cutting device in accordance with an embodiment of the present invention.

Cover member 120 may be configured to be removably attachable to housing 110. For example, cover member 120 may be a cap that is attachable to housing 110. As illustrated in FIG. 8, cover member 120 may include a cavity 250 formed by one or more wall portions 255 of cover member 120. Portions of carriage 185, cutting member 190, and/or housing 110 may be received in cavity 250 of cover member 120 (e.g., when cover member 120 is attached to housing 110). Cover member 120 may include an aperture 260 (e.g., a cutting member aperture) that may be configured to receive a portion (e.g., portion 240 and/or other portions) of cutting member 190 (e.g., when cover member 120 is attached to housing 110). Cover member 120 may also include an aperture 265 (e.g., locking member aperture) that is configured to receive a portion 175 of locking member 165 (e.g., when cover member 120 is attached to housing 110). As illustrated in FIG. 2, cover member 120 may have a portion 270 that may be diagonal or slanted or relative to a lengthwise direction (e.g., centerline 275) of cover member 120. Portion 270 may help in forming an attachment between cover member 120 and a diagonal or slanted portion of housing 110 (e.g., when portion 175 of locking member 165 is received in aperture 265).

Figure 9:
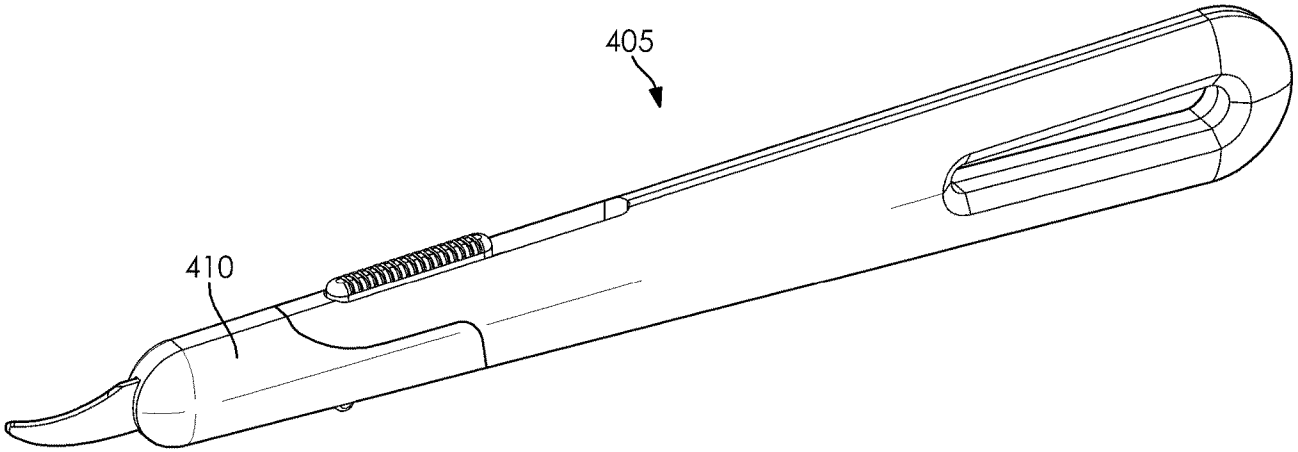
FIG. 9 is a perspective view of an exemplary cutting device in accordance with an embodiment of the present invention.
Figure 10:
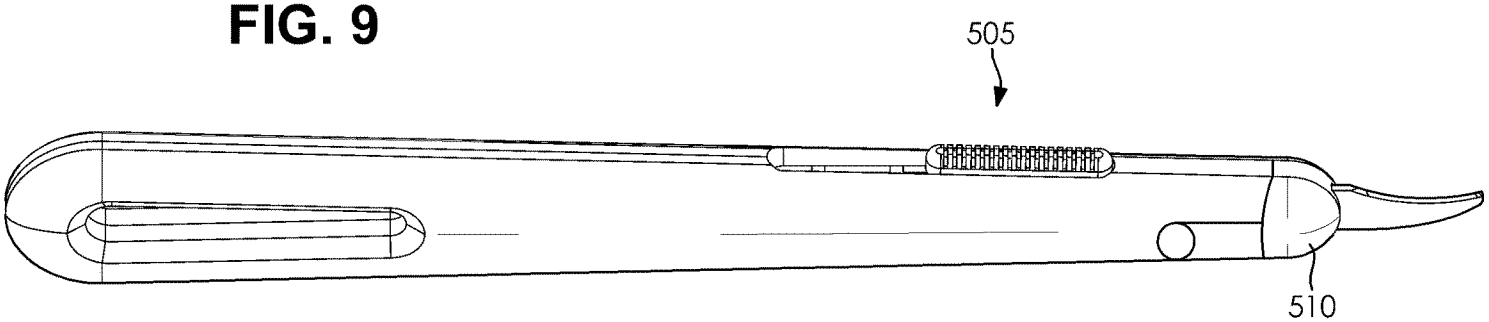
FIG. 10 is a perspective view of an exemplary cutting device in accordance with an embodiment of the present invention.
Figure 11:
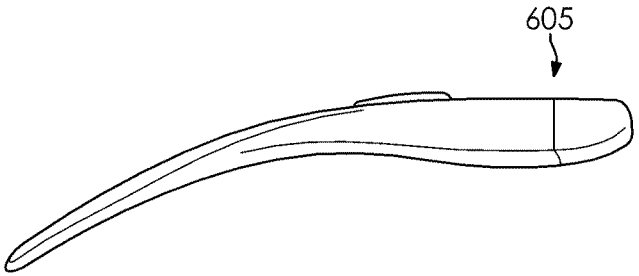
FIG. 11 is a perspective view of an exemplary cutting device in accordance with an embodiment of the present invention.

FIGS. 9, 10, and 11 illustrate additional exemplary embodiments of the present device and method. For example, FIG. 9 illustrates a cutting device 405 having a cover member 410 that may have a substantially s-shaped portion for attaching to a housing. Also for example, FIG. 10 illustrates a cutting device 505 having a cover member 510 that may have an extending portion for attaching to the housing. Further for example, FIG. 11 illustrates a cutting device 605 having an exemplary housing and cover member.

The exemplary disclosed device and method may provide an intuitively simple and safe technique for cutting materials and/or replacing blades of a cutting device. The exemplary disclosed device and method may be used in any application involving cutting materials safely. For example, the exemplary cutting device and method may be used in applications such as seam rippers, box cutters, utility knives, precision knives, and any other suitable application for cutting materials.

Figure 12:
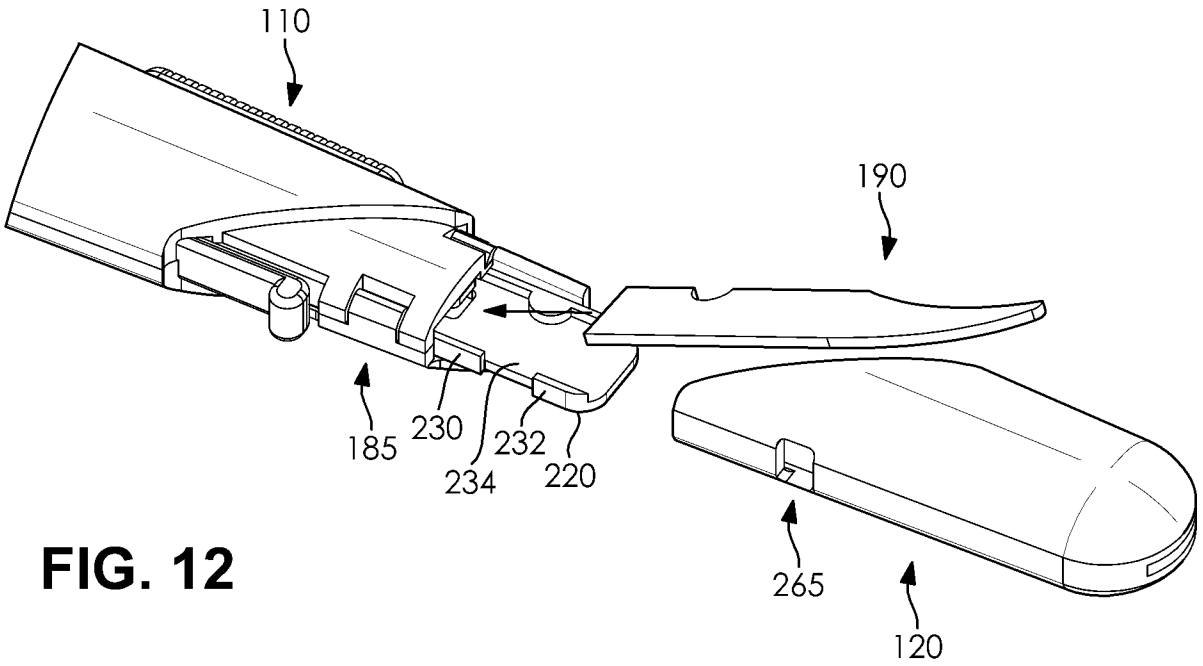
FIG. 12 is a perspective view of an exemplary cutting device in accordance with an embodiment of the present invention.

An exemplary operation of cutting device 105 will now be described. As illustrated in FIGS. 4 and 12, housing 110 is provided including locking member 165. Cutting assembly 115 is disposed in housing 110. Cutting member 190 is removably disposed in cavity 220 of carriage 185. Cover member 120 may remain detached from housing 110.

As illustrated in FIG. 4, cutting assembly 115 including cutting member 190 disposed in carriage 185 may be in an extended position. Member 205 may be disposed at a forward portion of aperture 158 as illustrated in FIG. 4 when cutting assembly 115 is in the extended position. When cutting assembly 115 is in the extended position, portions (e.g., portions 230 and/or 232) of carriage 185 substantially block movement (e.g., flexible movement transverse to a length of cutting device 105) of locking member 165 (e.g., substantially blocks movement of portions 170 and 175 of locking member 165).

Cutting assembly 115 may be moved from the extended position illustrated in FIG. 4 to the retracted position illustrated in FIG. 5. A user may move cutting assembly 115 by pushing member 205 of carriage 185. For example, cutting assembly 115 may be in the extended position when protrusion 238 of carriage 185 is received in recess 163 of housing 110, cutting assembly 115 may be in the retracted position when protrusion 238 is received in recess 161, and cutting assembly 115 may be in a half-extended position when protrusion 238 is received in recess 162. For example, a user may push on member 205 to cause portion 236 to flex, allowing protrusion 238 to be removed from (e.g., disengaged from) recesses 161, 162, and/or 163. For example, a user may push on member 205 to flex portion 236 to disengage protrusion 238 from one of recesses 161, 162, or 163, and then push member 205 to move cutting assembly 115 to another position (e.g., to move cutting assembly 115 from one of the extended position, retracted position, or half-extended position to another one of those positions). It is also contemplated that housing 110 may include additional recesses so that cutting assembly 115 may be disposed in additional positions (e.g., three-quarters extended). Accordingly for example, protrusion 238 may be received in recesses 161, 162, and/or 163 to index and/or maintain cutting assembly 115 in a plurality of positions (e.g., extended position, retracted position, half-extended position, and/or any other suitable position within housing 110). Member 205 may be disposed at a rear portion of aperture 158 as illustrated in FIG. 5 when cutting assembly 115 is in the retracted position. In the retracted position, portions (e.g., portions 230 and/or 232) of carriage 185 may be substantially moved so that movement of locking member 165 (e.g., flexible movement transverse to the length of cutting device 105) is not substantially blocked (e.g., portions 170 and/or 175 of locking member 165 are not substantially blocked by portions 230 and/or 232 of carriage 185). For example, portion 175 of locking member 165 may be aligned with aperture 234 of carriage 185. For example, when portion 175 and aperture 234 are aligned, locking member 165 may be moved (e.g., flexed), so that portion 175 moves into aperture 234, which may allow a user to remove cover member 120 as disclosed herein. For example, cover member 120 may be removed when aperture 234 and portion 175 are aligned, and cover member 120 may not be removed when aperture 234 and portion 175 are not aligned.

Figure 6:
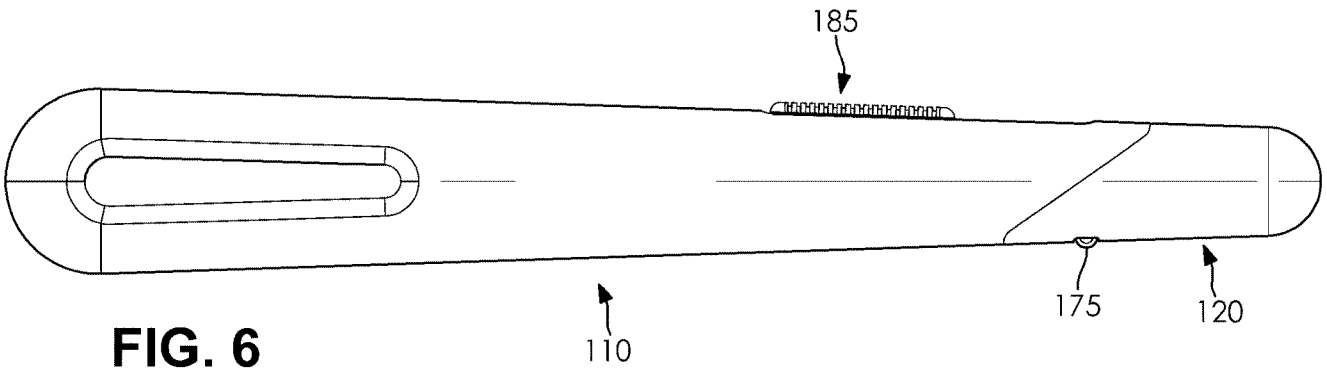
FIG. 6 is a side view of an exemplary cutting device in accordance with an embodiment of the present invention.

As illustrated in FIG. 6, a user of cutting device 105 may attach cover member 120 to housing 110 when cutting assembly 115 is in the retracted position. As cover member 120 is placed onto housing 110, locking member 165 may be moved (e.g., flexibly moved transverse to the length of cutting device 105) because locking member 165 is not substantially blocked (e.g., portions 170 and/or 175 of locking member 165 are not substantially blocked by portions 230 and/or 232 of carriage 185, and aperture 234 and portion 175 are substantially aligned). Cover member 120 may be pushed by a user onto housing 110 until portion 175 of locking member 165 is received by aperture 265 of cover member 120 as illustrated in FIG. 6.

Figure 7:
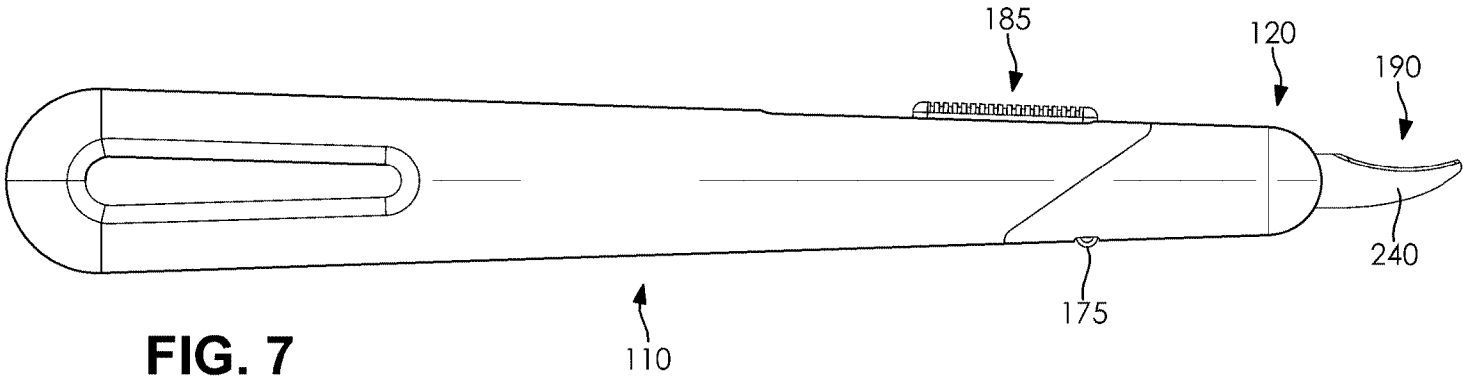
FIG. 7 is a side view of an exemplary cutting device in accordance with an embodiment of the present invention.

Cutting assembly 115 may be moved from the retracted position illustrated in FIG. 6 to the extended position illustrated in FIGS. 7 and 8. A user may move cutting assembly 115 by pushing member 205 of carriage 185. When cutting assembly 115 is in the extended position, portions (e.g., portions 230 and/or 232) of carriage 185 substantially block movement (e.g., flexible movement transverse to a length of cutting device 105) of locking member 165 (e.g., substantially blocks portions 170 and/or 175 of locking member 165). Portion 240 of cutting member 190 extends through and out of aperture 260 of cover member 120. For example, when cutting member 190 is disposed in carriage 185 that is retained in housing 110 by locked cover member 120 in the extended position, cutting member 190 may extend through cutting member aperture 260 of cover member 120. For example, carriage 185 and aperture 260 may be offset from a longitudinal centerline of cutting device 105 so that when cutting member 190 is disposed in carriage 185, cutting member 190 may be offset from a longitudinal centerline of cutting device 105 (e.g., the offset may be any suitable offset for facilitating use and blade change of cutting device 105 by a user such as, for example, up to 1.5 mm, up to 1 mm, or about 0.5 mm). Portion 175 of locking member 165 remains retained in aperture 265 of cover member 120 when cutting assembly 115 is in the extended position and cover member 120 is attached to housing 110 as illustrated in FIGS. 7 and 8. For example, portion 175 (or portions 175 and 170) may act as a locking button. For example, when carriage 185 is in the extended position and cover member 120 is attached to housing 110, locking member 165 locks cover member 120 to housing 110. Locked cover member 120 (e.g., cover member 120 locked to housing 110) may thereby retain cutting member 190. For example, locking the locking member (e.g., locking member 165) to cover member 120 by moving cutting assembly 115 to the extended position may include receiving a portion (e.g., portion 175) of locking member 165 in an aperture (e.g., aperture 265) of cover member 120, and blocking a movement of portions (e.g., portion 170 and/or portion 175) of locking member 165 with cutting assembly 115 being in the extended position. In the extended position illustrated in FIGS. 7 and 8 (e.g., with cutting member 190 retained by locked cover member 120), a user may use cutting device 105 to cut material using portion 240 of cutting member 190.

It is contemplated that cutting assembly 115 may be locked in the position illustrated in FIGS. 7 and 8. For example, cutting assembly 115 may be lockable in a forward position so as to cause cutting member 190 to remain extended out of aperture 260 of cover member 120. Cutting assembly 115 may be locked in the forward position by any suitable locking device such as, for example, a friction fit locking device, a latching mechanism, and/or a ratcheting mechanism.

After finishing use of cutting device 105 to cut material, a user may move cutting assembly 115 from the extended position illustrated in FIGS. 7 and 8 to the retracted position illustrated in FIG. 6. As illustrated in FIG. 5, a user of cutting device 105 may detach cover member 120 from housing 110 when cutting assembly 115 is in the retracted position. A user may move locking member 165 (e.g., flexibly moved transverse to the length of cutting device 105) because locking member 165 is not substantially blocked (e.g., movement of portions 170 and/or 175 of locking member 165 is not substantially blocked by portions 230 and/or 232 of carriage 185, and aperture 234 and portion 175 are substantially aligned). When carriage 185 is in the retracted position and cover member 120 is attached to housing 110, a portion (e.g., portion 175) of locking member 165 may be removable from aperture 265 (e.g., locking member aperture 265) and cover member 120 may be unlocked from housing 110. Portion 175 of locking member 165 may thereby be removed from aperture 265 of cover member 120. For example, unlocking locking member 165 from cover member 120 by moving cutting assembly 115 to the retracted position may include urging a portion (e.g., portion 175 and portion 170) of locking member 165 away from and out of an aperture (e.g., aperture 265) of cover member 120 when cutting assembly 115 is in the retracted position. Cover member 120 may be pushed by a user off of housing 110 as illustrated in FIG. 5.

A user of cutting device 105 may move cutting assembly 115 from the retracted position illustrated in FIG. 5 to the extended position illustrated in FIG. 4. If desired, a user may remove cutting member 190. For example, cutting member 190 may be removed from carriage 185 when cover member 120 is removed and carriage 185 is disposed in housing 110 in the extended position. For example, a user may replace a used cutting member 190 with a new cutting member 190 when cutting device 105 is in the configuration illustrated in FIG. 4 (or for example in a configuration close to the extended position). For example, a user of cutting device 105 may replace a relatively dull cutting member 190 that has been used many times for cutting material with a new cutting member 190.

The exemplary disclosed cutting device and method may provide an intuitively simple device and technique for safely and easily replacing blades of the cutting device. The exemplary device may allow users unfamiliar with the device to quickly, easily, and safely replace the blades. The exemplary device and method may also provide a user with a cutting device having a blade that may be resistant to dulling and may be used for relatively long periods of time without replacing a blade. The exemplary device and method may provide an ergonomically efficient device and method that allows a user to avoid frustration in using a cutting device, including during replacement of the device blades.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a housing;

a carriage that is movably disposed and retained in the housing, the carriage being movable between a retracted position and an extended position, the carriage extending further out of the housing in the extended position as compared to the retracted position;

a cutting member that is removably disposable in the carriage; and a cover member that is removably attachable to the housing;

wherein the housing includes a locking member;

wherein when the carriage is in the extended position and the cover member is attached to the housing, the locking member locks the cover member to the housing;

wherein when the cutting member is disposed in the carriage in the extended position, the cutting member is retained in the carriage by the locked cover member;

wherein the locking member is a cantilevered member;

wherein the cover member includes a locking member aperture configured to receive a portion of the locking member; and wherein the carriage includes a carriage aperture that is aligned with the portion of the locking member when the carriage is in the retracted position.

2. The cutting device of claim 1, wherein the cover member includes a cutting member aperture.

3. The cutting device of claim 2, wherein when the cutting member is disposed in the carriage that is retained in the housing by the locked cover member in the extended position, the cutting member extends through the cutting member aperture of the cover member.

4. The cutting device of claim 1, wherein the locking member that is the cantilevered member is an elongated member including a flexible portion.

5. The cutting device of claim 1, wherein the cutting device is one of a seam ripper, a box cutter, a utility knife, or a precision knife.

6. The cutting device of claim 1, wherein when the carriage is in the extended position and the cover member is attached to the housing, the carriage retains the portion of the locking member in the locking member aperture.

7. The cutting device of claim 1, wherein when the carriage is in the retracted position and the cover member is attached to the housing, the portion of the locking member is removable from the locking member aperture.

8. The cutting device of claim 1, wherein when the carriage is in the retracted position and the cover member is attached to the housing, the portion of the locking member is movable into and out of the locking member aperture of the cover member and the carriage aperture.

9. The cutting device of claim 1, wherein:

the carriage aperture is an aperture formed in a wall portion of the carriage;

the carriage aperture is aligned with the portion of the locking member when the carriage is in the retracted position; and the wall portion of the carriage is configured to block the locking member from flexibly moving when the carriage is in the extended position.

10. A method, comprising:

providing a housing that includes a locking member disposed at an exterior surface of the housing;

providing a cutting assembly, the cutting assembly including a cutting member that is removably disposed in a carriage;

disposing and retaining the cutting assembly in the housing, the cutting assembly being movable between a retracted position and an extended position;

removably attaching a cover member to the housing, the cover member including an aperture;

moving the cutting assembly to the retracted position, and when the cutting assembly is in the retracted position, attaching the cover member to the housing and moving a portion of the locking member into and out of the aperture of the cover member; and both retaining the portion of the locking member in the aperture of the cover member and blocking a movement of the portion of the locking member out of the aperture of the cover member when the cutting assembly is in the extended position.

11. The method of claim 10, further comprising removing the unlocked cover member from the housing and then moving the cutting assembly to the extended position.

12. The method of claim 11, further comprising removing the cutting member from the carriage when the cover member is removed and the carriage is disposed in the housing in the extended position.

13. The method of claim 10, further comprising unlocking the locking member from the cover member by urging the portion of the locking member out of the aperture of the cover member when the cutting assembly is in the retracted position.

14. The method of claim 10, wherein the cutting member includes ceramic material.

15. The method of claim 10, wherein:

the locking member includes a flexible member; and the portion of the locking member, which is movable into the aperture of the cover member, is located at an end portion of the flexible member.

16. A seam ripper, comprising:

a housing that is a seam ripper handle;

a blade carriage that is movably disposed and retained in the housing, the blade carriage being movable between a retracted position and an extended position, the blade carriage extending further out of the housing in the extended position as compared to the retracted position;

a ceramic blade that is removably disposable in the blade carriage; and a cap that is removably attachable to the housing;

wherein the housing includes a locking member having a locking button, the locking button attached to the housing by the locking member;

wherein when the blade carriage is in the extended position and the cap is attached to the housing, the locking button is disposed in an aperture of the cap and the locking member locks the cap to the housing;

wherein when the ceramic blade is disposed in the blade carriage in the extended position and the locking button is disposed in the aperture of the cap, the ceramic blade is retained in the blade carriage by the locked cap;

wherein the locking member is a cantilevered member that includes an elongated, flexible member;

wherein the locking button is located at an end portion of the elongated, flexible member;

wherein the aperture of the cap is configured to receive the locking button; and wherein the blade carriage includes a carriage aperture that is aligned with the locking button when the blade carriage is in the retracted position.

17. The seam ripper of claim 16, wherein the ceramic blade is a hooked blade formed from Zirconium Oxide.

18. The seam ripper of claim 16, wherein when the ceramic blade is disposed in the blade carriage, the ceramic blade is offset from a longitudinal centerline of the seam ripper.

19. The seam ripper of claim 16, wherein:

the locking button is movable into and out of the aperture of the cap based on the elongated, flexible member flexibly moving in a direction that is transverse to a direction of a length of the seam ripper handle; and the locking button is locked in the aperture of the cap based on a portion of the blade carriage blocking the elongated, flexible member from flexibly moving when the blade carriage is in the extended position.

* * * * *